US005149209A

United States Patent [19]

Condrey et al.

[11] Patent Number: 5,149,209

[45] Date of Patent: Sep. 22, 1992

[54] HAIR DRYER WITH AUDIBLE UNPLUG ALARM

[75] Inventors: Richard M. Condrey; Jerry O. Lorant, both of Birmingham, Ala.

[73] Assignee: Jerry O. Lorant, Birmingham, Ala.

[21] Appl. No.: 663,613

[22] Filed: Mar. 4, 1991

[51] Int. Cl.[5] ..... F24H 3/02; H05B 1/02

[52] U.S. Cl. ..... 392/379; 392/385; 219/506; 340/655

[58] Field of Search ..... 392/383-385, 392/409, 410, 379; 219/506, 248, 507; 340/635, 644, 654-656; 99/337, 342, 344; 307/326, 125-126; 34/96-101; 361/1

[56] References Cited

U.S. PATENT DOCUMENTS

| | | | |
|---|---|---|---|
| 3,505,664 | 4/1970 | Morris | 340/644 |
| 3,815,110 | 6/1974 | Davidson | 240/213 R |
| 3,838,385 | 9/1974 | Bloomingdale | 439/135 |
| 3,846,777 | 11/1974 | Brown | 340/654 |
| 4,085,309 | 4/1978 | Godel et al. | 34/97 |
| 4,542,284 | 9/1985 | Thaler et al. | 219/506 |
| 4,550,358 | 10/1985 | Crowley et al. | 361/1 |
| 4,687,906 | 8/1987 | Fujishama et al. | 361/1 |
| 4,894,643 | 1/1990 | Thompson et al. | 62/131 |

*Primary Examiner*—Bruce A. Reynolds
*Assistant Examiner*—John A. Jeffery
*Attorney, Agent, or Firm*—Barnes, Kisselle, Raisch, Choate, Whittemore & Hulbert

[57] ABSTRACT

A hair dryer that includes a case having a handle and a barrel, and a fan positioned in the barrel and coupled to an electric motor for blowing hair through the barrel. An electrical resistance heating element is disposed in the barrel for generating heat to dry hair, and an electrical cord extends from the handle and terminates in a plug adapted to be removably received in a utility outlet for supplying power to the hair dryer. An operator switch is carried by the handle and connected in series with at least the electric motor across the power lines of the cord. An audible alarm is connected across the switch and in series with the motor across the power conductors of the plug and cord, such that placement of the switch in an open condition, with the plug inserted in a utility outlet, results in current flow through the alarm device and generation of an audible alarm signal.

5 Claims, 1 Drawing Sheet

HAIR DRYER WITH AUDIBLE UNPLUG ALARM

The present invention is directed to electrical appliances of a type adapted to be powered by utility power, and more particularly to an appliance such as a hair dryer that should be unplugged from the utility power outlet for safety reasons when not in use.

BACKGROUND AND OBJECTS OF THE INVENTION

As used in the present application and claims, the term "utility power" applies to electrical power supplied at a level that corresponds with the power supplied by a local publicly or privately owned power generator. In North America, utility power is typically supplied at a voltage of about 110 or 220 VAC and a frequency of 60 hertz, and is available for use through power outlets of standard configuration. In other countries, utility power maybe supplied at other voltage levels and/or frequencies.

Although many types of electrical appliances, such as dishwasher and televisions, can remain plugged into the utility power source when not in use, there are certain types of electrical appliances that must and should be unplugged for safety reasons when not in use. One appliance of the latter type is an electric hair dryer, which is typically used in a bathroom or other area where water is present, and can present a significant safety hazard if left plugged into the utility power outlet when not in use. Other appliances of this type include electric curling irons and electric shavers. Manufacturers of such appliances typically attach a warning label or tag to the appliance advising the user to unplug the appliance when not in use. Such warning, however, is frequently forgotten or ignored. Inadvertent contact with water can and does present a significant hazard of personal injury including death by electrical shock, particularly to small children.

It is therefore a general object of the present invention to provide an alarm device for use in electrical appliances of the described character that automatically warns an operator or user to unplug the appliance when the appliance is turned off. Another and more specific objection of the invention is to provide an appliance alarm device of the described character that may be readily incorporated into appliances of conventional design and construction, that is economical to implement, and that cannot be readily defeated or rendered inoperative by a user.

SUMMARY OF THE INVENTION

An electrical appliance in accordance with the present invention includes a power plug adapted to be removably inserted into a utility power outlet, and a switch coupled to the plug and responsive to an operator for selectively applying and removing utility power to and from the appliance. An alarm apparatus includes an audible alarm responsive to application of electrical power for generating in audible warning signal, and circuitry coupled to the plug and switch for applying electrical power from the plug to the alarm when power is removed from the appliance by the switch and the plug remains inserted in the utility outlet. The switch in the preferred embodiment of the invention comprises a normally open switch that may be closed for connecting utility power at the plug to the appliance electronics. The alarm and circuitry are connected in series across the switch, so that closure of the switch automatically short circuits the alarm and thereby prevents generation of the alarm signal when the switch is closed. On the other hand, when the switch is opened and the plug left inserted in a utility outlet, electrical power at reduced level is fed to the alarm for generation of the alarm signal.

The preferred embodiment of the invention comprises a hair dryer that includes a case having a handle and a barrel, and a fan positioned in the barrel and coupled to an electric motor for blowing air through the barrel. An electrical resistance heating element is disposed in the barrel for generating heat to dry hair, and an electrical cord extends from the handle and terminates in a plug adapted to be removably received in a utility outlet for supplying power to the hair dryer. An operator switch is carried by the handle and connected in series with at least the electric motor across the power lines of the cord. An audible alarm is connected across the switch and in series with the motor across the power conductors of the plug and cord, such that placement of the switch in an open condition, with the plug inserted in a utility outlet, results in current flow through the alarm device and generation of an audible alarm signal. This alarm signal, by its intensity, continuity and audible presence, constitutes a warning to the user, the effect of which is to create an instinctive human reaction that will prompt cause and require the user to unplug the hair dryer, thus eliminating the potential hazard of accidental electric death or serious electrical injury.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENT

Figure 1:
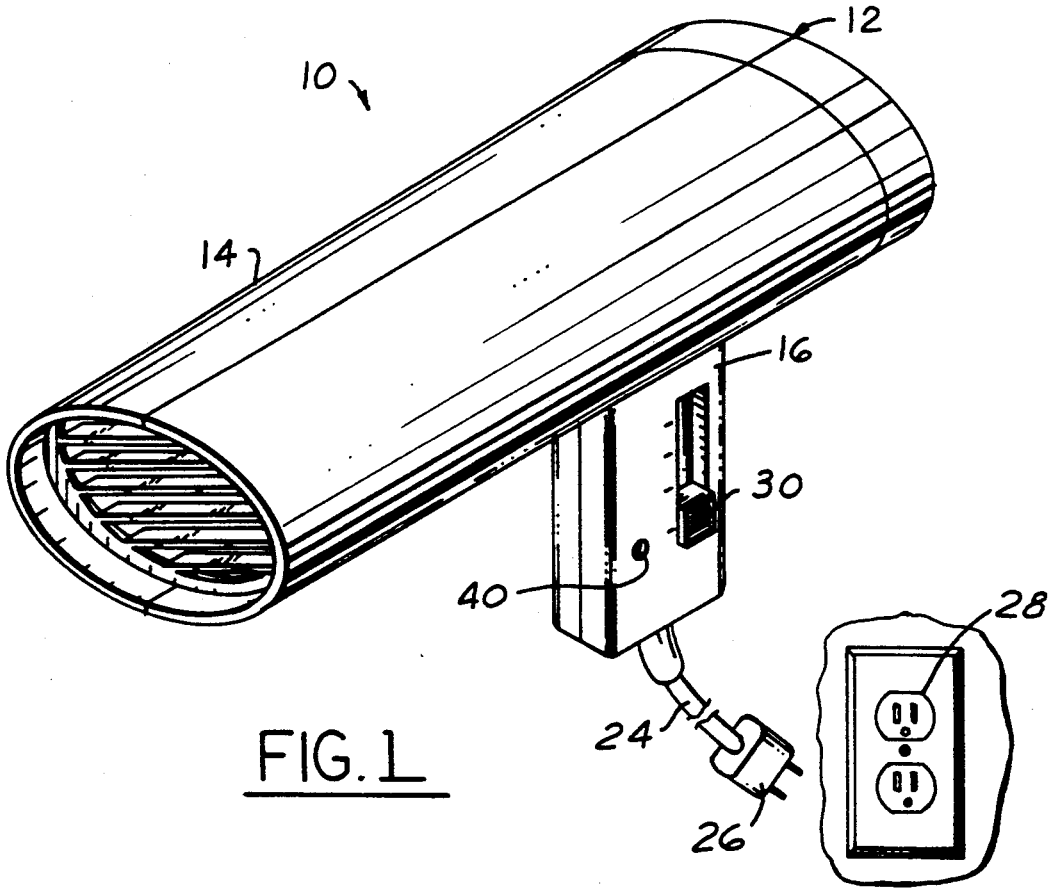
FIG. 1 is a perspective view of a hair dryer equipped with an unplug alarm device in accordance with the present invention.
Figure 2:
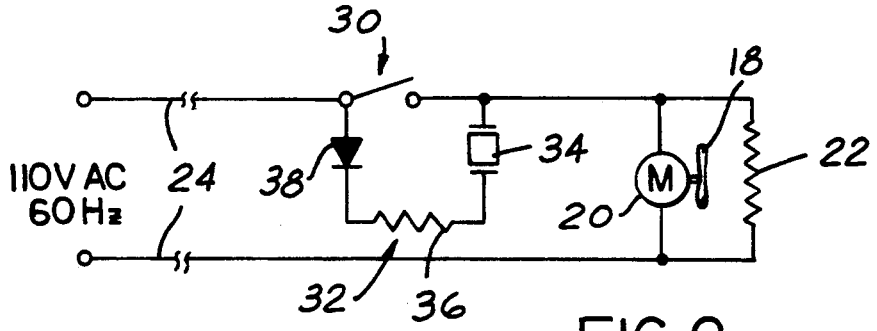
FIG. 2 is a partial electrical schematic diagram of the hair dryer illustrated in FIG. 1.

The drawing illustrates a hair dryer 10 in accordance with a presently preferred embodiment of the invention as comprising a case 12 (FIG. 1) including an elongated hollow barrel 14 and a handle 16, projecting laterally from barrel 14. A fan 18 (FIG. 2) is positioned within barrel 14, and is coupled to an electric motor 20 for blowing air through barrel 14 across an electrical resistance heating element 22 likewise positioned within barrel 14. An electrical cord 24 extends from the base of handle 16, and terminates in a plug 26 (FIG. 1) adapted to be removably inserted into a utility wall outlet 28 of standard construction and configuration. Utility power at a suitable voltage and frequency, such as 110 VAC and 60 Hz, is typically supplied to outlet 28 from a remote utility source (not shown). An electrical switch 30 is carried by handle 16, and is electrically connected in series with the parallel combination of motor 20 and heating element 22 across the conductors of power cord 24 and plug 26. Switch 30 is illustrated as a multiposition slide switch in FIG. 1, and may be adapted for applying power at various levels to motor 20, either simultaneous with or separately from applying power to heater 22. In this connection, it will be recognized that switch 30 is shown as a single poll switch for proposes of simplicity in FIG. 2. Thus, as shown in FIG. 2, switch 30 when closed applies electrical power to motor 20 and heating element 22 so as to generate a flow of air within barrel 14 (FIG. 1) across the heating element and out of the open end of the barrel. On the other hand, power is removed from motor 20 and heating element 22 when switch 30 is in the open position. To the extent thus far described, hair dryer 10 is of conventional construction.

In accordance with the present invention, alarm apparatus 32 is connected to switch 30 for warning an operator to remove plug 26 from wall outlet 28 in the event that switch 30 is placed in the open position and the appliance remains plugged to the wall outlet. Alarm apparatus 32 includes a buzzer 34 connected in series with a resistor 36 and a diode 38 across the normally open terminals of the switch 30. Thus, when switch 30 is open and plug 26 remains inserted in outlet 28, alternating current half-waves, rectified by diode 38, are fed through resistor 36 to buzzer 34, and thence to motor 20 and heating element 22. However, resistor 36 limits the applied current to a level at which motor 20 and heating element 22 are not appreciably energized. On the other hand, buzzer 34 is energized by the half-wave rectified signals applied thereto to generate an audible alarm signal advising the operator that the hair dryer should be unplugged from the wall outlet. When switch 30 is closed to operate the hair dryer, the switch effectively short circuits the series combination of diode 38, resistor 36 and buzzer 34 so that the buzzer is deenergized. Thus, the audible alarm is silent when the hair dryer is in use, but is energized to advise the operator to unplug the hair dryer when the hair dryer is not in use and left plugged in.

Alarm apparatus 32 is disposed within handle 16 so as to position buzzer 34 internally adjacent to an aperture 40 (FIG. 1) in the sidewall of the handle. Thus, the alarm signals are clearly audible to a user through aperture 40. On the other hand, the alarm circuitry is entirely enclosed within handle 16, and therefore cannot be readily removed or defeated without disassembly of the hair dryer.

The hair dryer hereinabove disclosed fully satisfies all of the objects and aims previously set forth. However, it will be appreciated that the principles of the invention are by no means limited specifically to hair dryers of the type illustrated in the drawing, but in fact find application in other types of appliances in which it is desired to warn an operator or user to unplug the appliance when not in use. Indeed, the limited number and size of the components employed in the preferred embodiment of the invention render the invention readily amenable to use in connection with a wide variety of appliances, such as hair curling irons and electric shavers. Indeed, the principles of the invention may be readily implemented in appliances, such as electric trains, that are often used by children and that should be unplugged when not in use, and household irons including steam irons for use as home appliances in ironing clothing -i.e. generally, portable hand-held appliances that pose the risks of electrical shock or hazard to the user.

We claim:

1. In an electrical appliance adapted to be powered by utility power and including a power plug adapted to be removably inserted into a utility power outlet, and switch means coupled to said plug and responsive to an operator for selectively applying and removing utility power to and from said appliance, alarm apparatus for warning an operator to remove said plug from the utility outlet when power is removed from the appliance by said switch means, said apparatus comprising:

alarm means carried by said appliance and responsive to application of electrical power for providing an audible alarm signal, and circuit means coupled to said plug and to said switch means for applying electrical power from said plug to said alarm means when power is removed from said appliance by said switch means and said plug is inserted in a utility outlet, and for removing power from said alarm means when power is applied to said appliance by said switch means, said switch means comprising switch contact means having a closed condition for applying electrical power from said plug to said appliance and an open condition for removing power from said appliance, and said alarm means and said circuit means being connected in series across said switch contact means such that closure of said switch contact means short circuits said alarm means and said circuit means for removing power from said alarm means.

2. The electrical appliance set forth in claim 1 wherein said circuit means includes means for limiting current through said circuit means and said alarm means when said switch means is open so as to prevent energization of said appliance.

3. The electrical appliance set forth in claim 2 wherein said alarm means comprises a buzzer.

4. A hair dryer that includes:

a case having a handle and a barrel, a fan positioned in said barrel and coupled to an electric motor for blowing air through said barrel, electrical resistance heating means in said barrel, an electrical cord extending from said handle and terminating in a plug adapted to be removably received in a utility outlet for supplying electrical utility power to said hair dryer, electrical operator switch means carried by said handle and coupled to said cord, said switch means having an open condition in which power is removed from said motor and heating means, and a closed condition in which electrical power at said cord from said plug is applied at least to said motor, and an alarm comprising an audible alarm device and circuit means connecting said device across said switch in series with said motor across said plug, such that placement of said switch means in said open condition with said plug inserted in a utility outlet results in current flow through said alarm device and generation of an audible alarm signal, while placement of said switch in said closed condition short circuits said alarm device and applies power directly from said plug and cord at least to said motor.

5. The hair dryer set forth in claim 4 further comprising an aperture in said handle, said alarm device being positioned within said handle adjacent to said aperture.

* * * * *